US007633391B2

(12) United States Patent
Voglewede et al.

(10) Patent No.: US 7,633,391 B2
(45) Date of Patent: Dec. 15, 2009

(54) ROBUST TACTICAL UNATTENDED GROUND SENSOR NETWORKING

(75) Inventors: Paul Voglewede, N. Chili, NY (US); Scott Cloutier, Fairport, NY (US); Robert Post, Victor, NY (US)

(73) Assignee: Harris Corporation, Melbourne, FL (US)

( * ) Notice: Subject to any disclaimer, the term of this patent is extended or adjusted under 35 U.S.C. 154(b) by 332 days.

(21) Appl. No.: 11/598,911

(22) Filed: Nov. 14, 2006

(65) Prior Publication Data

US 2008/0111885 A1 May 15, 2008

(51) Int. Cl.
*G08B 13/00* (2006.01)

(52) U.S. Cl. ..... 340/541; 340/539.1; 340/517; 340/933

(58) Field of Classification Search ..... 340/539.1, 340/539.22, 933, 506, 521, 517, 501, 539.26, 340/691.1, 692, 3.1, 531, 541; 348/152, 348/143
See application file for complete search history.

(56) References Cited

U.S. PATENT DOCUMENTS 4,649,524 A * 3/1987 Vance ..... 367/13
5,661,699 A * 8/1997 Sutton ..... 367/132
7,173,526 B1 * 2/2007 Monroe ..... 340/521
7,184,413 B2 * 2/2007 Beyer et al. ..... 370/254
7,233,781 B2 * 6/2007 Hunter et al. ..... 455/404.1
2004/0164859 A1 8/2004 La Spisa
2005/0099980 A1 * 5/2005 Delaney et al. ..... 370/338
2005/0243858 A1 * 11/2005 Vitebsky et al. ..... 370/447
2006/0120397 A1 * 6/2006 Kreiner et al. ..... 370/437
2006/0273895 A1 * 12/2006 Kollin ..... 340/539.17
2008/0034872 A1 * 2/2008 Tonelli et al. ..... 73/602

FOREIGN PATENT DOCUMENTS

JP 10 308692 A 11/1998
WO WO 2004/010398 1/2004

OTHER PUBLICATIONS

MACA—A new Channel Access Method for Packet Radio by Phil Karn, KA9Q, Proc. of the 9th ARRL/CRRL Amateur Radio Computer Networking Conference, p. 134, Sep. 1990.
A Channel Access Protocol for Tactical IP Networks Using Software Defined VHF Radios By Michael T. Cahill and William E. Glase, appears in MILCOM 2002. Proceedings, Oct. 2002, vol. 1, pp. 363-368.

* cited by examiner

*Primary Examiner*—Daniel Previl
(74) *Attorney, Agent, or Firm*—Harness, Dickey & Pierce, P.L.C.

(57) ABSTRACT

An unattended sensor is provided for use in a surveillance system. The sensor is generally comprised of: a detector that generates an electrical signal in response to a physical stimulus proximate to the sensor; a signal processor adapted to receive the electrical signal from the detector and operable to generate an event message based on the electrical signal; a transceiver operable to send and receive messages over a wireless radio link; and a channel access mechanism operable to negotiate access to the radio link in accordance with an access protocol, where the access protocol is employed by radios and other communication devices in the system.

23 Claims, 5 Drawing Sheets

ROBUST TACTICAL UNATTENDED GROUND SENSOR NETWORKING

CROSS-REFERENCE TO RELATED APPLICATIONS

This application is a related to U.S. patent application Ser. No. 11/598,910 entitled "MULTIPURPOSE UNATTENDED SENSOR NODE WITH RELAY CAPABILITY" and filed concurrently herewith. The disclosure of this application is incorporated herein by reference.

FIELD

The present disclosure relates to an unattended ground sensor and, more particularly, to a sensor node that has been configured for military application, including having interoperability with radio equipment deployed within the sensor network.

BACKGROUND

Throughout the world, military and homeland security forces face an increasing need to provide safety and security to troops and high-value assets. Wireless surveillance systems are emerging as a way of meeting this need. However, when developing a communications system for military application, a variety of obstacles need to be overcome. For example, conventional sensors do not typically employ frequency-hopping or signal jamming avoidance methods when transmitting alarm signals over the network. Likewise, conventional sensors are not configured to be interoperable with the radio equipment used by military personnel.

Therefore, it is desirable to develop an unattended ground sensor which is configured for military application. The statements in this section merely provide background information related to the present disclosure and may not constitute prior art.

SUMMARY

An unattended sensor is provided for use in a surveillance system. The sensor is generally comprised of: a detector that generates an electrical signal in response to a physical stimulus proximate to the sensor; a signal processor adapted to receive the electrical signal from the detector and operable to generate an event message based on the electrical signal; a transceiver operable to send and receive messages over a wireless radio link; and a channel access mechanism operable to negotiate access to the radio link in accordance with an access protocol, where the access protocol is employed by radios and other communication devices in the system.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
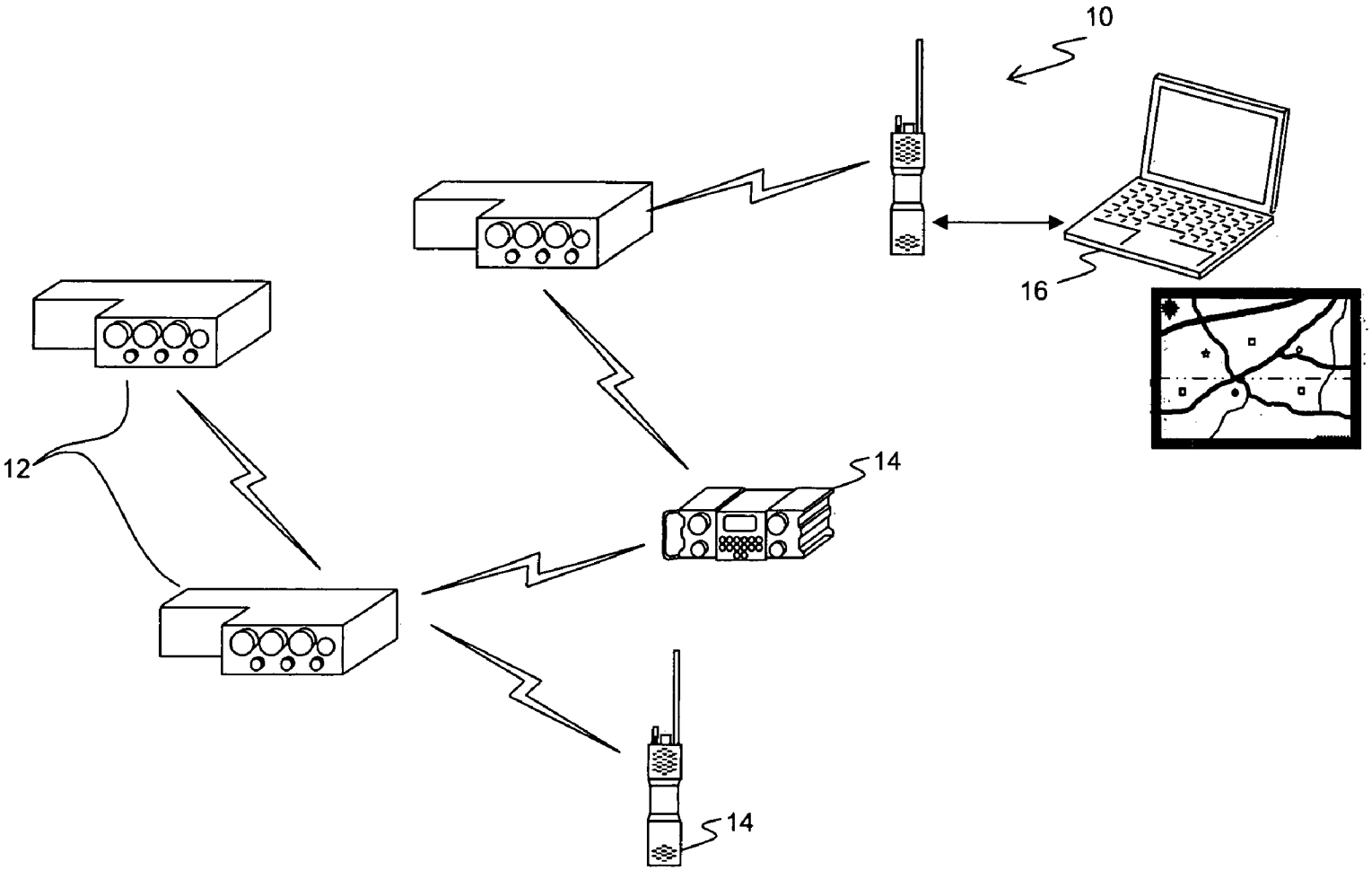
FIG. 1 is a diagram of an exemplary surveillance system.

FIG. 1 depicts an exemplary surveillance system. The surveillance system is comprised of a plurality of unattended ground sensors 12 and one or more monitoring devices 14. Ground sensors 12 are configured to gather surveillance data and broadcast the data across a wide area wireless network in a manner further described below. Surveillance data may be intended for a command node having a dedicated sensor management application 16 and/or may be intercepted by various monitoring devices 14 residing in the network. It is understood that the sensor nodes may also serve as relays between other devices in the network.

Figure 2:
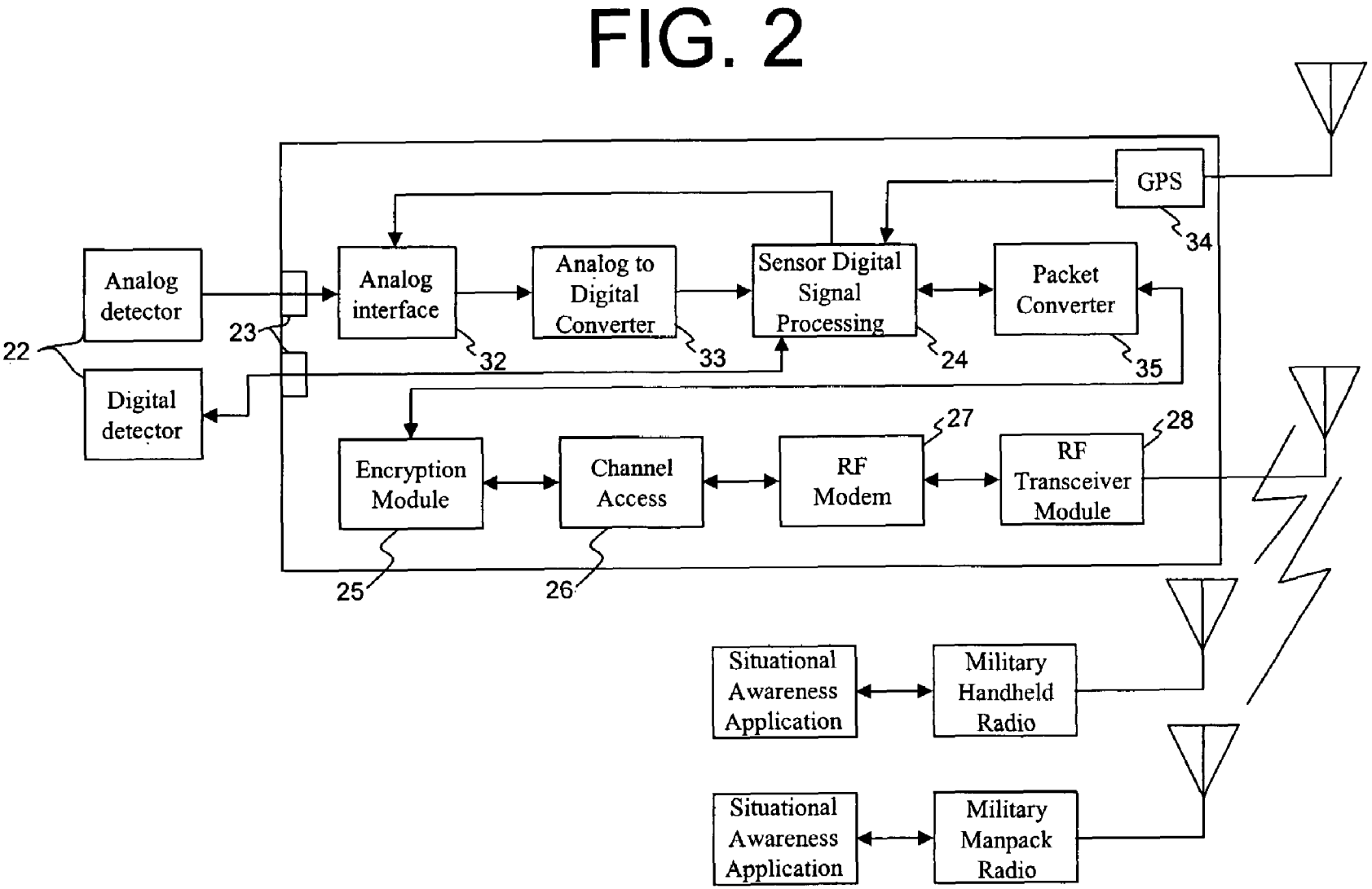
FIG. 2 is block diagram of an exemplary configuration for an unattended sensor in the surveillance system.

FIG. 2 provides an exemplary configuration for a ground sensor 12. The ground sensor 12 is comprised generally of one or more detectors 22, a signal processor 24, a channel access mechanism 26, and a radio frequency (RF) transceiver 28. Each of these components, along with other preferred components, is further described below. It is to be understood that only the relevant components are discussed below, but that other known components (e.g., power source) are needed to control and manage the overall operation of the sensor. Within the broader aspects of the disclosure, it is also envisioned that these components may be arranged in different configurations.

A detector 22 is a device that generates an electric signal in response to a physical stimulus proximate to the detector. The detector 22 may be an analog device, such as a magnetic detector, a passive infrared detector or a seismic detector, or a digital device, such as an acoustic detector or a digital imager. A magnetic detector detects magnetic field changes caused by ferrous material such as weapons or vehicles moving through an area. A passive infra-red detector detects incident infrared changes caused by a thermal mass such as personnel or vehicles moving through an area. A seismic detector detects vibrations that are analyzed to determine the type of intrusion. It is to be understood that other type of detectors are intended to fall within the scope of this disclosure. Although one or more detectors may be integrated into the sensor, it is preferable that the sensor is configured with at least two interfaces 23 for coupling different detectors. In this way, a sensor can be configured with different types of detectors depending on the surveillance requirements. Upon deployment of the sensor, a detector may be electrically connected via the interface to the sensor.

Electrical signals from detectors are processed by the digital signal processor 24. The digital signal processor 24 is operable to assess the signals and determine if there is an alarm or event which merits reporting. If so, the digital signal processor 24 formulates a message which is to be sent over the network. For example, in the case of a passive infrared detector, a temperature value is reported to the digital signal processor. An exemplary algorithm for an infrared detector may evaluate how the temperature varies over time. A temperature baseline is determined by averaging the temperature of the recent past. Subsequent temperature values are compared to the baseline value. When a temperature value falls outside the standard deviation of the baseline value, an alarm may be triggered. Alternatively, the temperature value may be further evaluated to determine if an event message is merited. For instance, the temperature value must exceed some absolute temperature threshold before an alarm is triggered. It is understood that the baseline value is adjusted over time to account for changes in the ambient temperature. Moreover, it is understood that other types of algorithms may be employed for an infrared detector and that different types of detectors will employ different types of algorithms. In the case of a digital detector, it is envisioned that the detection algorithm may be embedded in the detector.

In the case of an analog detector, analog signals from the detector 22 must be converted to a digital signal prior to being input to the digital signal processor 24. Thus, the sensor further includes an analog-to-digital converter 33 interposed between the detector 22 and the digital signal processor 24. In addition, an analog interface 32 may precede the a/d converter 33. The analog interface 32 is configured to receive analog signals from a detector 22 and operable to filter or otherwise condition the signals. It is readily understood that suitable signal conditioning will depend on the type of signal being received. Moreover, it is envisioned that the signal conditioning may be adjusted using a feedback from the signal processor depending on the type of detector.

A global positioning system (GPS) module 34 may be embedded in the sensor. The GPS module 34 is adapted to receive a timestamp as well as positional information in a manner well known in the art. The digital signal processor 24 in data communication with the GPS module 34 may opt to tag outgoing event messages with a timestamp of when the alarm occurred and/or positional information for the sensor. Other means for determining the current time or capturing positional information for the sensor are also contemplated by this disclosure.

In an exemplary embodiment, a packet converter 35 is adapted to receive data from the digital signal processor 24. The packet converter 35 in turn encapsulates the data received from the signal processor into one or more data packets. The data packets are defined in accordance with the Internet protocol or some other transport protocol. In this way, the event messages may be sent to and received by other IP compatible devices residing in the network or routed to IP compatible devices outside of the wireless network. It is understood that event messages need not be sent in packet form.

The sensor further includes an RF modem 27 and an RF transceiver module 28. Messages may be sent and received by the sensor using these components. In a preferred embodiment, the wireless radio link employed by the sensor is designed to be compatible with existing military radio technology. In other words, each of these components is preferably of military grade. For example, the RF modem 27 may implement a frequency hopping scheme; whereas, the RF transceiver module 28 is a VHF network module that operates in the frequency range from 30 MHz to 108 MHz. Exemplary RF modems and RF transceiver modules can be found in various military grade radios such as the RF-5800 handheld radio and RF-5800 manpack radios commercially available from Harris Corporation. In this way, the sensor is able to communicate with handheld radios as well as other communication devices deployed within the network in a manner further described below. This provides reduced logistics in parts and training. In addition, it minimizes the lifecycle cost of a system if the user already owns a piece of the system or has multiple users.

To reduce channel contention, the sensor also employs a channel access mechanism 26. Channel access is the scheme by which a radio node negotiates access and is granted permission to utilize a shared communication medium. In an exemplary embodiment, the sensor node uses the Multiple Access with Collision Avoidance (MACA) protocol or variants thereof. It is envisioned that other channel access protocols may be employed within the broader aspects of this disclosure. However, this protocol is particularly suited for mobile communication devices which use tactical line of sight VHF channels.

Figure 3:
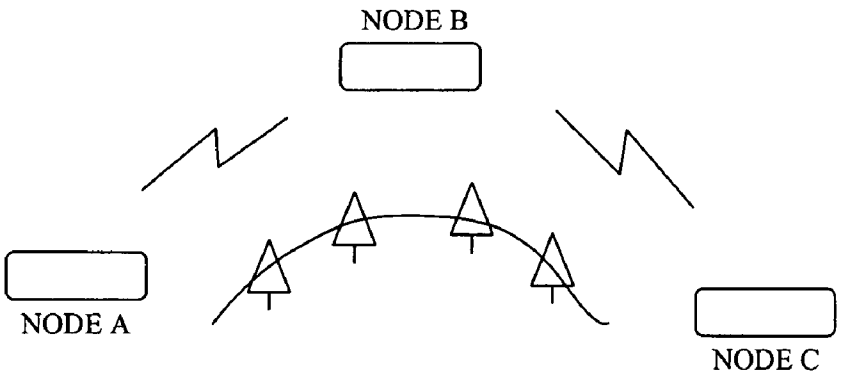
FIG. 3 is a diagram illustrating a hidden node scenario which may be experienced by line-of-sight radios.

FIG. 3 illustrates a simple example of a hidden node collision. The network includes three radio nodes (A, B and C). Node B can communicate with both A and C, but Nodes A and C are separated by an obstruction. If Node A is transmitting data, Node C's modem cannot hear it and may well start to transmit its own data. The resulting collision will likely cause reception problems for Node B.

In comparison, the MACA protocol requires a node to gain access to the channel before transmitting packet data to another node. This is accomplished using a short, robust handshake procedure. If Node A has packet data to send to Node B, a request-to-send (RTS) message directed to Node B will be sent over the channel. Node B hears the RTS message from Node A and responds with a clear-to-send (CTS) message to Node A. Node A will not begin transmitting until it hears the CTS message from Node B. The amount of data to be sent is included in the RTS message and echoed by the responder in the CTS message. In this way, a node overhearing either message knows how long to wait before initiating a transmission. Rather than transmit the amount of data in the handshake messages, a variant to this protocol provides a maximum transmission time on the channel that provides a level of fairness among the stations.

When a node overhears an RTS message to another node, it inhibits its own transmission long enough for the node to respond with a CTS message. Likewise, when a node overhears a CTS message addressed to another node, it inhibits its own transmitter long enough for the other station to send its data. The act of holding off data transmissions avoids packet collisions on the channel. After overhearing either an RTS or CTS message, each node adds a random amount to a minimum interval each node is required to wait.

An additional handshake called the DROP response was proposed by S. Vitebsky and J. Kroon in "A Distributed Trunking Mechanism for AD Hoc VHF Tactical Networking" MILCOM 1997. The DROP response is intended to reduce protocol overhead. After the packet data has been received, node B responds with a DROP message to node A. The DROP message gives other stations such as node C an indication that the channel is now free. Another benefit of the DROP is that is gives hidden nodes, which can only hear the CTS part of a conversation, an earlier indication that the channel is free rather than waiting the maximum transmission time on the channel. The reception of a DROP message keeps the station synchronized with the current status of the channel and provides for better channel utilization.

The channel access protocol is designed to avoid collisions among multiple nodes on a single channel, but it is possible that a collision may occur. The handshaking signals are short in comparison to the data and thus the loss of an RTS message is less costly than simply sending the data packet. A linear backoff RTS retry mechanism is built into channel access protocol for these types of situations. If a node cannot acquire the channel after a certain number of retries the data will be re-queued and the node will re-schedule its chance to obtain the channel.

Since multiple nodes can access the channel, there needs to exist a mechanism that is efficient and guarantees fairness of access. The MACA protocol uses binary exponential backoff to provide nodes a chance to gain access to the channel.

Alternatively, channel access protocol may employ a mini-slotted CSMA/CA scheme as proposed by S. Vitebsky and J. Kroon in "A Distributed Trunking Mechanism for AD Hoc VHF Tactical Networking" MILCOM 1997.

Figure 4:
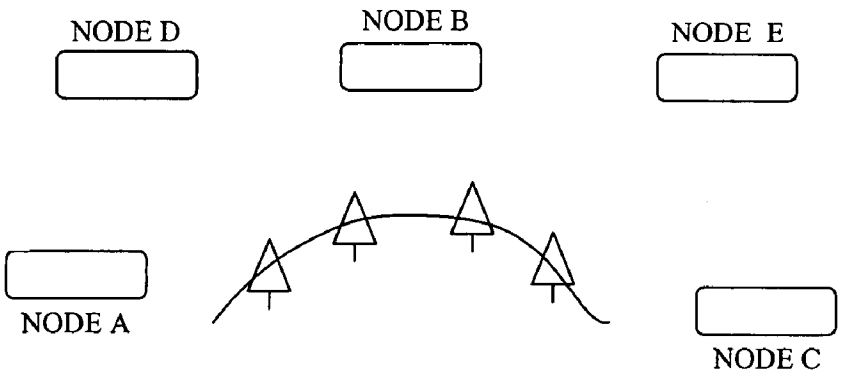
FIG. 4 is a diagram illustrating two additional nodes to the network shown in FIG. 3.

FIG. 4 shows two additional nodes (D and E) to the network in FIG. 3. Nodes D and E have direct contact with everyone in the network. Suppose that nodes D and E have data to send while node A is transferring data to node B. Nodes D and E will hold off since they detect that node A has the channel. When both D and E detect that the channel is free, they will roll the dice and pick a slot to transmit in. In this example, suppose node D picks slot 8 and E picks slot 12. At the start of D's slot, node D will send out an RTS message addressed to the destination of its data. Node E hears the RTS and will miss the opportunity to transfer its data in slot 12. However, when node E detects that the channel is free again, it will roll the dice for a slot and have another chance to send its data. Slotted access protocols often require time synchronization between stations, which can add operational complexity to the system. Using relative time synchronization based on the timing of the on-air signaling allows acceptable collision avoidance performance without adding complexity of use.

For situations where the channel is idle, a node with packet data to send will immediately attempt to gain access to the channel without incurring the delay to roll the dice and pick a slot. The time randomness associated with the packet arrival provides reasonable collision avoidance. When the channel has been busy, it is much more likely that more than one node has data waiting to be sent, so the mini-slotting mechanism is used by the channel access protocol to avoid collisions.

The MACA protocol may also be used to adjust the bit rate of the modem. The recipient of an RTS message can estimate the channel signal between it and the sender and return this information via the CTS message to the sender. The sender can then change the data rate to get event messages through the channel in the most efficient manner. If the channel is noisy, then it will select a more robust but lower data rate. If the channel is clear, it can use a higher data rate and hence be on the channel for less time. In this way, the channel access mechanism cooperatively operates with the modem to set an appropriate bit rate for the transmission.

A fundamental architectural decision that must be made when designing a channel access protocol for military applications is where the protocol is implemented with respect to the encryption device. Traditionally, the interface to the encryption device is a baseband audio or serial data and therefore the encryption device is interposed between the channel access protocol and the radio modem. With reference to FIG. 2, the encryption device 25 is preferably interposed between the signal processor 24 and the channel access mechanism 26. The encryption device 25 is operable to encrypt and decrypt messages. Although various algorithms are contemplated, the encryption module 25 preferably employs a Citadel encryption algorithm. In this arrangement, the encryption device can have detailed and immediate information about channel conditions, even to the sub-symbol level.

Figure 5:
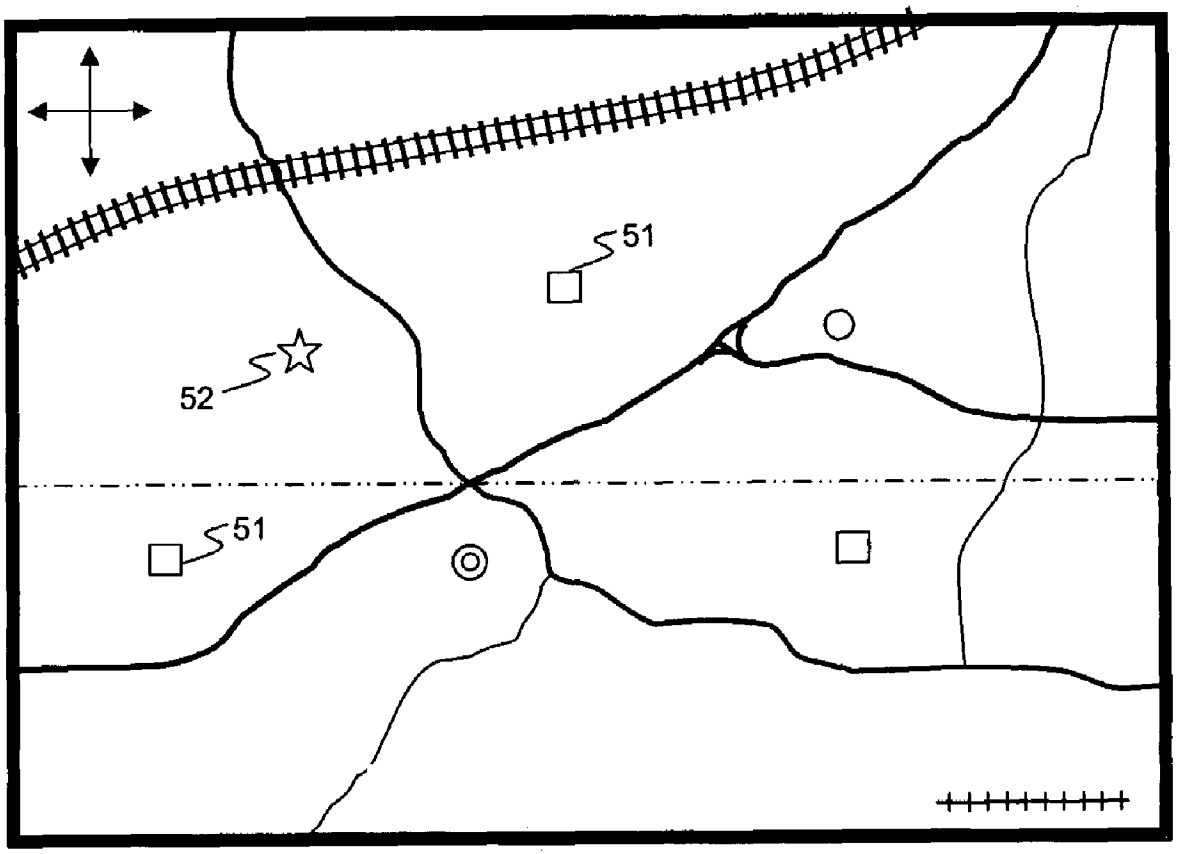
FIG. 5 is a diagram of an exemplary map which may be displayed by a sensor management application.

In operation, the sensor node is operable to transmit event messages over a wireless radio link to other communication devices in the network. These communication devices may be the intended destination for an event message or may operate as a relay node to relay the message to other nodes in the network. At least one of the communication devices is likely to be designated as a command node. In an exemplary embodiment, the command node may be configured with a situational awareness software application. The situational awareness application is configured to display surveillance data in real-time and preferably in a geographical context (e.g., on a map) as shown in FIG. 5. For instance, a sensor alarm and/or each sensor node may be display as a unique icon as indicated as on a map. Likewise, the command node may be displayed as an icon as indicated at 52. The command node also logs events in a data store for subsequent assessment.

In an exemplary embodiment, the monitoring device may be a handheld radio device. The radio device is equipped with a transceiver for sending and receiving voice data over the network and a channel access mechanism that negotiates access to the radio link in accordance with the same channel access protocol employed by the sensor node. In this way, the radio device is able to receive event messages from sensor nodes residing in the network.

Figure 6:
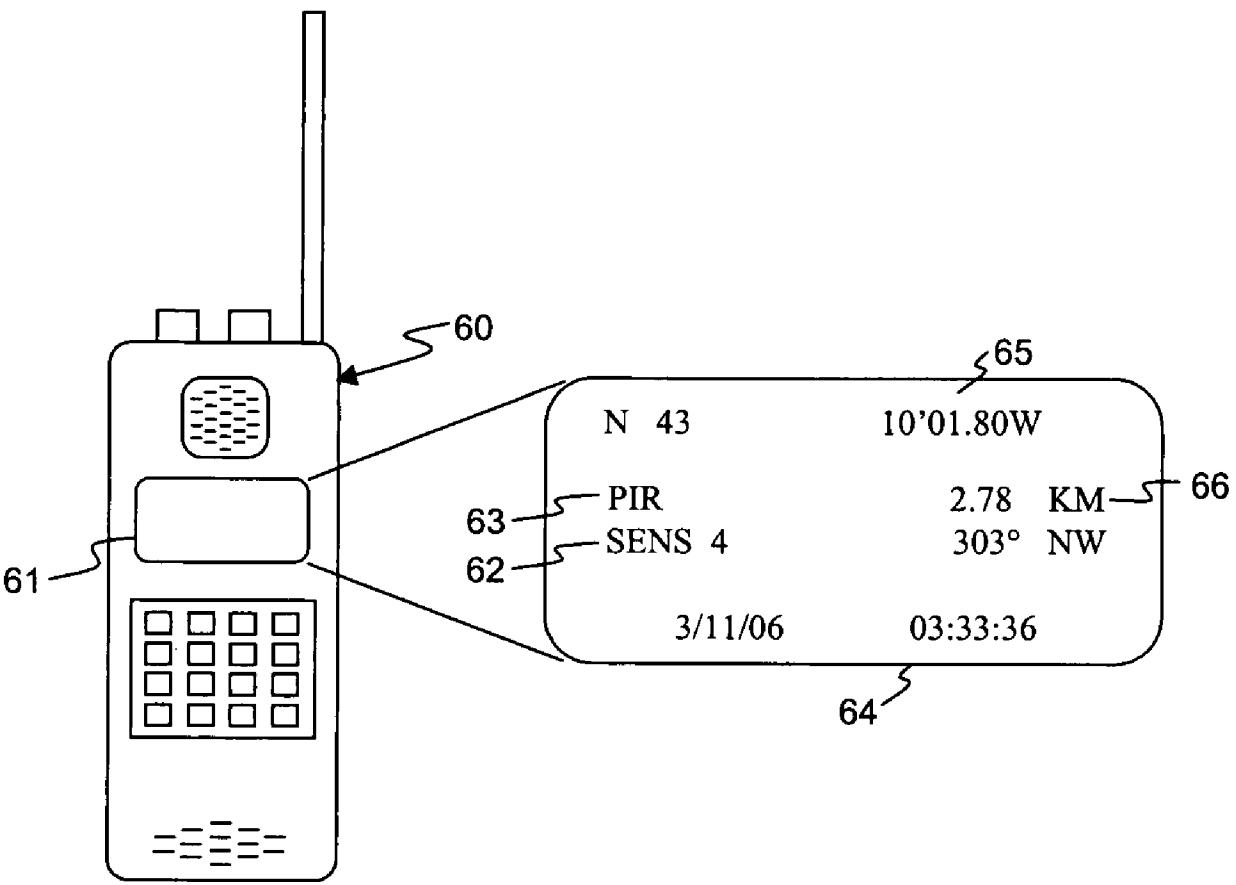
FIG. 6 is a diagram of an exemplary handheld radio displaying indicia of an event message received from a sensor.

In addition, the radio device is equipped with a signal processor adapted to receive the event messages and provide indicia of the event to the radio operator. For instance, the radio device may be operable to generate an audible indicator in response to receiving an event message from a sensor node. With reference to FIG. 6, the radio device 60 may be equipped with a display device 61. In these instances, the radio device 60 may generate indicia of the event on a display. The indicia may include an identifier for the sensor node 62, an identifier as the type of detector 63 which originated the event, the time the event occurred 64 and/or location information 65 for the sensor. If the radio device is also equipped with a GPS module, the display may further include the position of the sensor node 66 in relation to the radio. Radios equipped with a larger display and more computing power (e.g., a manpack radio device) may be configured with the situational awareness application described above. Alternatively, a portable computing device, such as a laptop computer, configured with the situational awareness application may be interfaced with a radio device to receive event and display event messages from a sensor node.

The following description is merely exemplary in nature and is not intended to limit the present disclosure, application, or uses.

What is claimed is:

1. A surveillance system, comprising:

an unattended sensor having a detector that generates an electrical signal in response to a physical stimulus proximate to the sensor;

a signal processor adapted to receive the electrical signal from the detector and operable to generate event messages based on the electrical signal;

a transceiver adapted to receive the event messages and operable to send the event messages over a wireless radio link;

a channel access mechanism operable to negotiate access to the radio link in accordance with an access protocol, where the channel access mechanism receives messages from other nodes in the system indicating that a given node is about to receive a transmission and delays any transmissions from the sensor to the given node;

an encryption module interposed between the signal processor and the channel access mechanism and operable to encrypt messages received from the signal processor; and a radio device having a transceiver operable to send and receive voice data over the radio link; and a channel access mechanism operable to negotiate access to the radio link in accordance with the same access protocol.

2. The surveillance system of claim 1 wherein the access protocol is further defined as a Multiple Access with Collision Avoidance protocol.

3. The surveillance system of claim 1 wherein the radio device further includes a signal processor adapted to receive the event messages from the unattended sensor and operable to generate an audible indicator in response to the event messages.

4. The surveillance system of claim 1 wherein the radio device further includes a signal processor adapted to receive the event messages from the unattended sensor and operable to generate an indicia for the event messages on a display associated with the radio device.

5. The surveillance system of claim 1 wherein the unattended sensor further includes a global positioning system in a data communication with the signal processor, such that event messages are tagged with positional data for the sensor.

6. The surveillance system of claim 5 further comprises a sensor management application associated with the radio device, wherein the sensor management application is adapted to receive event messages from the unattended sensor and operable to display the event messages on a map using the positional data associated with the event messages.

7. The surveillance system of claim 1 further comprises a sensor management application associated with the radio device, wherein the sensor management application is operable to send command messages to the sensor.

8. The surveillance system of claim 1 wherein the radio device is operable to transmit data over the radio link to the unattended sensor.

9. The surveillance system of claim 1 wherein the transceiver of the unattended sensor and the radio device is further defined as a VHF network module operating in a frequency range of 30 to 108 MHz.

10. The surveillance system of claim 9 wherein the transceiver operates over frequency channels that are 25 kHz.

11. The surveillance system of claim 1 wherein the sensor further comprises a modem interposed between the channel access mechanism and the transceiver and operable to transmit event messages in accordance with a frequency hopping scheme.

12. The surveillance system of claim 1 wherein the detector is further defined as at least one of a seismic detector, a magnetic detector, a passive infra-red detector, an acoustic detector or a digital imager.

13. An unattended sensor configured for use with a radio in a surveillance system, comprising:

a detector that generates an electrical signal in response to a physical stimulus proximate to the sensor;

a signal processor adapted to receive the electrical signal from the detector and operable to generate an event message based on the electrical signal;

a transceiver operable to send and receive messages over a wireless radio link;

a channel access mechanism adapted to receive event messages from the signal processor and messages from the transceiver, wherein the channel access mechanism is operable to formulate a request to send message to an intended recipient prior to transmitting the event message and operable to transmit the event message upon receipt of a clear to send message from the intended recipient, the channel access mechanism further adapted to receive messages from other nodes in the system indicating that a given node is about to receive a transmission and operable to delay any transmissions from the sensor to the given node; and an encryption module interposed between the signal processor and the channel access mechanism and operable to encrypt messages received from the signal processor.

14. The unattended sensor of claim 13 wherein the channel access mechanism operates in accordance with a Multiple Access with Collision Avoidance protocol.

15. The unattended sensor of claim 13 wherein the channel access mechanism is operable to estimate channel signal quality of the radio link based on the clear to send message and adjust bit rate of a modem in accordance with the channel signal quality.

16. The unattended sensor of claim 13 wherein the event messages are sent in data packets in accordance with the Internet Protocol.

17. The unattended sensor of claim 13 wherein the encryption module employs a Citadel encryption algorithm.

18. The unattended sensor of claim 13 further comprises a global positioning system in a data communication with the signal processor, such that event messages are tagged with positional data for the sensor.

19. The unattended sensor of claim 13 wherein the detector is embedded within an enclosure for the sensor.

20. The unattended sensor of claim 13 further comprises an external port configured to detachably connect different types of detectors to the sensor.

21. The unattended sensor of claim 13 wherein the detector is further defined as at least one of a seismic detector, a magnetic detector, a passive infra-red detector, an acoustic detector or a digital imager.

22. The unattended sensor of claim 13 further comprises a modem interposed between the channel access mechanism and the transceiver and operable to transmit event messages in accordance with a frequency hopping scheme.

23. The unattended sensor of claim 13 wherein the transceiver is further defined as a VHF network module operating in a frequency range of 30 to 108 MHz.

* * * * *

UNITED STATES PATENT AND TRADEMARK OFFICE

CERTIFICATE OF CORRECTION

PATENT NO. : 7,633,391 B2
APPLICATION NO. : 11/598911
DATED : December 15, 2009
INVENTOR(S) : Voglewede et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 363 days.

Signed and Sealed this

Ninth Day of November, 2010

David J. Kappos

David J. Kappos
*Director of the United States Patent and Trademark Office*